United States Patent [19]

Ahroni

[11] 4,080,039

[45] Mar. 21, 1978

[54] FUSABLE ELECTRICAL PLUG

[76] Inventor: Joseph M. Ahroni, Pier 39, Room 201, Seattle, Wash. 98124

[21] Appl. No.: 759,183

[22] Filed: Jan. 13, 1977

Related U.S. Application Data

[63] Continuation of Ser. No. 700,473, Jun. 28, 1976, which is a continuation of Ser. No. 520,457, Nov. 4, 1974, abandoned.

[51] Int. Cl.[2] ..... H01H 85/12; H01R 13/68

[52] U.S. Cl. ..... 339/147 R; 337/197; 337/198; 339/166 R

[58] Field of Search ..... 339/103 R, 103 M, 107, 339/147 R, 147 P, 19 P, 166 R; 337/197, 198, 207, 208, 255, 256, 262, 231, 237

[56] References Cited

U.S. PATENT DOCUMENTS

| | | | |
|---|---|---|---|
| 1,974,700 | 9/1934 | Adams | 337/198 |
| 2,458,203 | 1/1949 | Rohrman | 337/198 |
| 2,599,023 | 6/1952 | Shaul | 337/197 |
| 2,668,885 | 2/1954 | Geriat | 339/107 X |
| 2,808,485 | 10/1957 | Cardone | 337/201 X |
| 3,833,875 | 9/1974 | Holdka | 337/198 X |

FOREIGN PATENT DOCUMENTS

| | | | |
|---|---|---|---|
| 973,364 | 9/1950 | France | 337/198 |

*Primary Examiner*—Roy Lake
*Assistant Examiner*—E. F. Desmond
*Attorney, Agent, or Firm*—Seed, Berry, Vernon & Baynham

[57] ABSTRACT

An electrical power plug having a fuse positioned within the plug housing. The fuse is formed from an elongated plastic fuse holder having a wire fuse element extending through each end. One end of the fuse holder contacts a planar contact plate which is connected to the electrical prong. An insulated wire entering the plug has a terminal secured to one end thereof, and means are provided for holding the terminal against the other end of the fuse wire. The fuse holder is readily removed from the plug for quick and inexpensive replacement of the fuse wire.

19 Claims, 4 Drawing Figures

FIG. 1
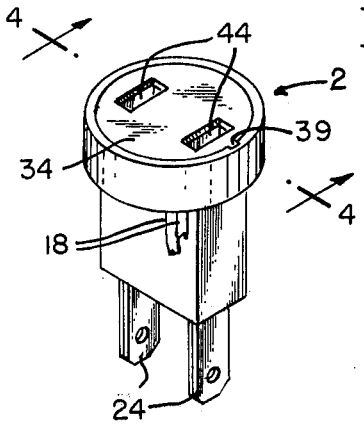
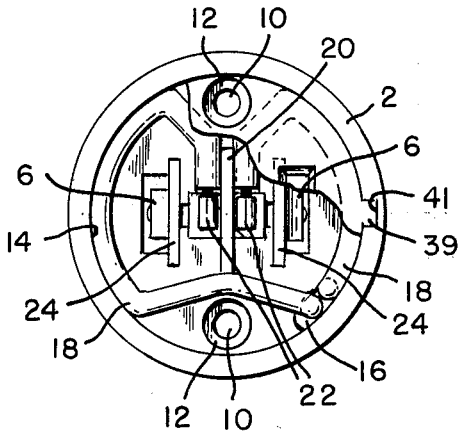
FIG. 3
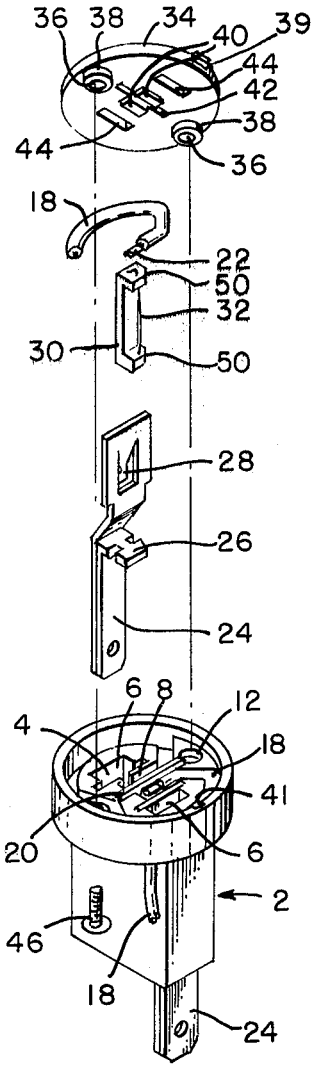
FIG. 2
FIG. 4
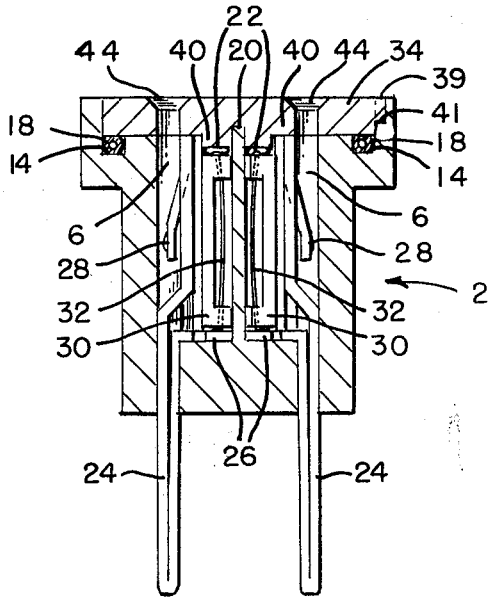

FUSABLE ELECTRICAL PLUG

This is a continuation of application Ser. No. 700,473, filed June 28, 1976 which is a continuation of application Ser. No. 520,457, filed Nov. 4, 1974, now abandoned.

BACKGROUND OF THE INVENTION

1. Field of the Invention

This invention relates to electrical power plugs and, more particularly, to an electrical power plug having an internal fuse in series with the power line and the prong connector.

2. Description of the Prior Art

Electrical fuses are in common use for protecting electric circuits in the event of a short circuit. Normally, such fuses are found at a central terminal box for protecting a large number of electrical outlets or are contained within the electrical device being protected. However, these prior art fuses cannot be used in many applications, either because the electrical device is not capable of holding a fuse or the electrical device is connected to electrical outlets having unknown current ratings. In particular, it is often desirable to place a fuse in series with a string of Christmas lamps. However, the lamps themselves are not large enough to hold a conventional fuse and the fuse rating of the socket to which the string of lamps is connected is often unknown. Compounding this problem is the practice of placing a large number of such strings in series.

Placing a fuse in series with a string of Christmas lights is desirable for reasons of economy as well as safety since a safety certification can be obtained using a smaller gauge wire in the circuit if the circuit also contains a fuse. This allows the use of a thinner wire without sacrificing safety, a feature which is particularly important in the field of Christmas tree decorations since a thin wire is easier to hide among the branches and is also less expensive. The high flammability of such Christmas trees also makes safety the factor of primary importance.

SUMMARY OF THE INVENTION

It is an object of the present invention to provide an electrical plug containing a fuse which is easily replaced.

It is another object of the present invention to provide such a fuse which is relatively inexpensive.

It is a further object of the present invention to provide a fuse which is extremely compact, thereby maintaining the plug at a conventional size.

It is a still further object of the present invention to provide a fusable electrical plug which is inherently reliable yet inexpensive to manufacture.

These and other objects of the present invention are provided by an elongated fuse holder carrying a wire fuse element extending beyond each end of the fuse holder. One end of the wire fuse rests against a planar contact plate connected to a conventional electrical prong adapted to be inserted in a wall socket. The other end of the wire fuse is held against a terminal which has been crimped to the end of the power line.

The fuse holder is extremely compact and is held in place in parallel alignment with the electrical prong, thereby insuring a compact configuration. The fuse element consists only of a wire, and no soldering or special manufacturing processes are needed. Thus the fusable electrical plug of the present invention is inexpensive to manufacture and the fuse is readily replaceable. Furthermore, the simplicity of the design insures that the plug is inherently reliable.

BRIEF DESCRIPTION OF THE DRAWINGS

FIG. 1 is an isometric view of the fusable plug of the present invention shown as assembled.

FIG. 2 is an exploded isometric view of the fusable plug of the present invention.

FIG. 3 is a top plan view of the fusable plug of the present invention.

FIG. 4 is a cross-sectional view of the fusable plug of the present invention taken along the lines 4—4 in FIG. 1.

DETAILED DESCRIPTION OF THE INVENTION

Referring now to the drawings, the plug housing 2 contains a pair of prong recesses 4 adapted to receive the prongs 24 and allow the ends thereof to pass through the end of the plug housing 2. The prongs 24 have formed thereon a plug tab 28 for contacting the prongs of an add-on plug which may be inserted at the rear of the plug housing 2. The plug housing 2 contains an add-on plug recess 6 for allowing entry of the add-on prongs (not shown) into the plug housing 2. Each of the prongs 24 contains a planar contact plate 26 which extends from the prong 24 at a right angle.

The plug housing 2 also contains fuse recesses 8 for allowing insertion of fuse holders 30. The fuse holder 30 is an elongated rectangular plane of plastic having integral tabs at each end, each of which contains a bore through which a wire fuse element 32 is inserted and an angled corner 50 corresponding to an angle on the corner of the fuse recesses 8 for insuring that the fuse holder 32 is properly oriented while being inserted into the fuse recess 8. Each end of the fuse element 32 is then bent over each end of the fuse holder 30. The fuse element 32 can be formed by any electrical conductor having a known resistance and a known melting point. The fuse element 30 will have various current ratings, depending upon the diameter of the wire that constitutes the fuse element 32. The diameter of the bores in the tabs is not critical and, therefore, a wide variety of wire diameters may be accommodated for a given sized bore. The fuse holder 30 is inserted into the fuse recess 8 until the end of the fuse wire 32 rests against the contact plate 26.

As best shown in FIG. 3, a pair of insulated leads 18 enter the plug housing 2 at a wire port 16 and enter grooves 14 which guide the leads 18 to the proper location. The leads 18 are forceably inserted in the grooves 14 to cause the leads 18 to be frictionally held in place. For this reason, the grooves 14 provide strain relief so that the leads 18 cannot be forceably removed from the plug. A contact 22 is secured to the conductors in the insulated leads 18, either by crimping or soldering. The contacts 22 are held securely in place above the end of the fuse holder 30 by the grooves 14. The contacts 22 are separated from each other by a projection 20 which, as will be explained hereinafter, also insures precise alignment of the cover 34 with the plug housing 2. The fuse holder 30 is easily removed from the plug housing 2 by forcing the ends of the prongs 24 into the plug housing 2, thereby forcing the fuse holder 30 out the other end of the plug housing 2 by the contact plate 26. A new fuse wire 32 is then cut to length and inserted through the holes at each end of the fuse holder 30 and bent over each end. Finally, the fuse holder 30 is reinserted in the fuse recess 8 after the end of the prong 24 has been pulled back to its original position.

A cover 34 is secured to the plug housing 2 by screws 46 which extend through the screw holes 10 in the plug housing 2 and engage the threaded bores 36 in the cover 34. The cover 34 contains an alignment slot 42 which receives the alignment projection 18 on the plug housing 2 to insure that the rotational position between the cover 34 and the plug housing 2 is correct. Further alignment is provided by projections 38 in the cover 34 which are inserted into cylindrical recesses 12 in axial alignment with the screw holes 10 and tab 39, which fits into recess 41. The cover 34 further includes contact projections 40 which hold the contacts 22 against the ends of the fuse holder 30 to insure conduction between the contacts 22 and the fuse wire 32. The fuse holder 30 is formed from a resilient plastic which, when compressed between the contact projections 40 and the contact plates 26, forms an arc to maintain the ends of the fuse wires 32 in contact with the contact plates 26 and contacts 22.

The cover 34 further includes a pair of add-on plug slots 44 through which the prongs of another plug (not shown) can be inserted to enter the add-on plug recesses 6 and contact the plug tab 28, integrally formed from the prongs 24. In this way, a plurality of plugs may be serviced from one socket. Note, however, that the add-on plugs will not be protected by the fuse of the present invention.

Although the fusable electrical plug of the present invention has been described as having a fuse in series with each prong 24, adequate short circuit protection can be obtained by including a fuse in series with only one of the prongs. In this case, the non-fused prong will be identical to those in conventional use. Thus, it is to be understood that the present invention is not to be limited to the precise structure disclosed.

The embodiments of the invention in which a particular property or privilege is claimed are defined as follows:

1. A fusable electrical plug comprising:

a resilient fuse holder;

a fuse element extending the length of said fuse holder and having ends which project from said fuse holder;

a conducting prong having a contact plate electrically connected thereto;

a plug housing having a prong recess and a fuse holder recess receiving said prong and said fuse holder, respectively, with one end of said fuse element contacting said contact plate, said recesses being laterally adjacent each other such that said fuse element is positioned alongside said prong;

an electrical conductor having a contact at one end thereof; and means for holding said contact against the other end of said fuse element and compressing said fuse holder whereby a substantially constant force is exerted on said contact plate and said contact by said fuse element.

2. The fusable electrical plug of claim 1, further including a wire guide which is an integral part of said plug housing for guiding said electrical conductor from an aperture in said plug housing to a point adjacent said fuse holder.

3. The fusable electrical plug of claim 2, wherein said wire guide frictionally engages said electrical conductor thereby restraining said electrical conductor from being forcibly removed.

4. The fusable electrical plug of claim 2, further including means for insulating said fuse element from said prong.

5. The fusable electrical plug of claim 4, including means for insuring that said fuse holder is properly oriented while being inserted into said fuse holder recess.

6. The fusable electrical plug of claim 4, further including:

a cover for said plug housing;

means for aligning said cover with said plug housing; and means for securing said cover to said plug housing.

7. The fusable electrical plug of claim 6, wherein said means for holding said contact against the other end of said fuse element is a projection integrally formed on said cover.

8. The fusable electrical plug of claim 6, further including:

an add-on plug recess in said plug holder adjacent said prong;

a slot in said cover aligned with said add-on plug recess and adapted to receive the prong of an add-on plug; and means for holding said prong against an add-on plug prong.

9. A fusable electrical plug comprising:

a plug housing having therein laterally adjacent prong and fuse recesses extending longitudinally thereof, said recesses having one of their ends open at a rear face of said housing;

a conducting prong positioned within said prong recess and extending along the length of said plug housing from a point adjacent the rear face of said housing and projecting forwardly beyond a front face of said housing, said prong having a contact plate projecting away from said prong into said fuse recess at the forward end thereof;

a fuse having electrical contacts at opposite ends thereof interconnected by a fusable conductor, said fuse being positioned within said fuse recess laterally adjacent said prong with the end contact at the forward end of said fuse abutting the rear face of said contact plate such that said fuse and conducting prong may be removed through the open rearward ends of said recesses by rearward lateral movement of said prong;

an electrical conductor having a contact at one end thereof; and means for holding said contact against the end contact at the rear of said fuse.

10. The fusable plug of claim 9, wherein a cover extends across the rear face of said plug housing, said cover having a pair of spaced apart prong-receiving apertures, and wherein a portion of said conducting prong within said prong recess is laterally offset from the forwardly projecting portion of said prong such that the prong of an add-on plug may be inserted through said aperture into said prong recess to contact said conducting prong without affecting the current rating of said fusable plug preset by the current capacity of said fuse.

11. The fusable plug of claim 26 wherein the offset portion of said prong includes a projecting contact leaf resiliently biased into the plane of the projecting portion of said conducting prong such that said leaf abuts a prong of an add-on plug inserted into said prong recess.

12. The fusable electrical plug of claim 9, wherein said fuse is resilient and said means for holding said contact against the end contact at the rear of said fuse compresses said fuse hereby a substantially constant force is exerted on said contact plate and said contact by the ends of said fuse.

13. The fusable electrical plug of claim 9, further including a wire guide which is an integral part of said plug housing for guiding said electrical conductor from an aperture in said plug housing to a point adjacent said fuse.

14. The fusable electrical plug of claim 13, wherein said wire guide frictionally engages said electrical conductor thereby restraining said electrical conductor from being forcibly removed.

15. The fusable electrical plug of claim 9, further including:

a cover for said plug housing;

means for aligning said cover with said plug housing; and means for securing said cover to said plug housing.

16. The fusable electrical plug of claim 15, wherein said means for holding said contact against the end contact at the rear end of said fuse is a projection integrally formed on said cover.

17. A fusable electrical plug comprising:

a non-conducting plug housing having therein a laterally spaced outer pair of longitudinal prong recesses and a central separated adjacent pair of longitudinal fuse recesses positioned side-by-side directly between and adjacent to said prong recesses, said fuse recesses each having a respective access opening located at one face of said housing, said housing including a non-conducting cover at said one face of the housing for closing said access openings, a pair of longitudinal conducting prongs in said prong recesses and projecting in parallel laterally spaced relation from an end face of said housing different from said one face, each of said prongs having a prong contact projecting into the adjoining fuse recess at the end thereof adjacent said end face of the housing, a pair of elongated fuses with contacts at their opposite ends located in said fuse recesses and adapted to pass through said access openings when said cover is removed, the fuse contacts at one end of the fuses engaging respective of said prong contacts, a pair of conductor leads passing side-by-side externally through said housing adjacent the other ends of said fuse recesses which are located remote from said end face of the housing, said conductor leads having respective conductor contacts positioned in the fuse recesses at said other ends and arranged to be engaged by respective of the fuse contacts at the other end of the fuses, and means for holding the fuse contacts in operative engagement with the prong contacts and the conductor contacts.

18. The fusable electrical plug of claim 17, wherein said plug is adapted to receive the prongs of an add-on plug with the prongs of said add-on plug being electrically connected to respective of said prongs of said fusable plug, said fusable plug further including a pair of spaced apart slots in the face of said fusable plug housing which is opposite from said end face thereof for receiving the prongs of said add-on plug, and a respective add-on plug recess in said housing aligned with each of said slots and positioned adjacent each conducting prong, said fuses being positioned between the prongs of said fusable plug and the prongs of said add-on plug.

19. A fusable electrical plug according to claim 17 in which said means for holding the fuse contacts in operative engagement with the prong contacts and the conductor contacts comprises a portion of said cover located at said access openings of the fuse recesses.

* * * * *